US005810636A

United States Patent [19]

Harned

[11] Patent Number: 5,810,636

[45] **Date of Patent: *Sep. 22, 1998**

[54] AUTOROTATING FLYING HAVING A SOUND-MAKING DEVICE

[76] Inventor: William D. Harned, 7437 Scenic View Dr., Knoxville, Tenn. 37938

[ * ] Notice: The term of this patent shall not extend beyond the expiration date of Pat. No. 5,505,650.

[21] Appl. No.: 619,917

[22] Filed: Mar. 20, 1996

[51] Int. Cl.[6] ..... A63H 27/127; A63H 1/28

[52] U.S. Cl. ..... 446/36; 446/47; 446/265

[58] Field of Search ..... 446/34, 36–48, 446/247, 265; 273/422–428

[56] References Cited

U.S. PATENT DOCUMENTS

| | | | |
|---|---|---|---|
| D. 84,029 | 4/1931 | Ditlevsen . | |
| 2,004,817 | 6/1935 | Linney | 446/247 X |
| 2,011,813 | 8/1935 | Heekin | 446/47 |
| 4,031,655 | 6/1977 | Ponciano et al. | 446/47 |
| 4,058,314 | 11/1977 | Wolf | 446/265 X |
| 4,183,168 | 1/1980 | Ross . | |
| 4,309,038 | 1/1982 | Spoon . | |
| 4,320,593 | 3/1982 | Sarkis | 446/47 |
| 4,856,793 | 8/1989 | Hannifin | 446/47 X |
| 4,904,219 | 2/1990 | Cox . | |
| 5,083,799 | 1/1992 | Thill | 446/47 X |
| 5,173,069 | 12/1992 | Litos et al. . | |
| 5,284,454 | 2/1994 | Randolph . | |

*Primary Examiner*—D. Neal Muir
*Attorney, Agent, or Firm*—Pitts & Brittian, P.C.

[57] ABSTRACT

An autorotating flyer (10) having a sound-making device (80) for generating an audible sound during descent of the autorotating flyer (10) to the ground after having been thrown into the air. The audible sound generated by the sound-making device (80) is a result of air being passed therethrough during rotation of the autorotating flyer (10). The sound-making device (80) may generate a whistle, a buzzing sound, or any other sound which may be created using the passage of air through the sound-making device (80).

6 Claims, 4 Drawing Sheets

AUTOROTATING FLYING HAVING A SOUND-MAKING DEVICE

This application in part discloses and claims subject matter disclosed in my earlier filed pending application, Ser. No. 08/353,057, filed on Dec. 9, 1994.

TECHNICAL FIELD

This invention relates to the field of hand-held, hand-launched flying toys. More specifically, the present invention relates to an autorotator having an associated device for producing a noise during the descent of the autorotator.

BACKGROUND ART

Many spinning, hand-launched, flying toys have been disclosed in the prior art. Typical of the art are those devices disclosed in the following United States and foreign patents:

| Patent No. | Inventor(s)/COUNTRY | Issue Date |
|---|---|---|
| Des. 84,029 | J. C. Ditlevsen | Apr. 28, 1931 |
| 913,381 | P. S. Hay | Feb. 23, 1909 |
| 1,110,738 | J. Berecz | Sept. 15, 1914 |
| 4,183,168 | R. E. Ross | Jan. 15, 1980 |
| 4,309,038 | D. M. Spoon | Jan. 5, 1982 |
| 4,904,219 | G. M. Cox | Feb. 27, 1990 |
| 5,173,069 | M. A. Litos, et al. | Dec. 22, 1992 |
| 5,284,454 | G. B. Randolph | Feb. 8, 1994 |
| 793,980 | FRANCE | Feb. 5, 1936 |
| 1,021,256 | FRANCE | Feb. 17, 1953 |
| 2,093,710A | UNITED KINGDOM | Sept. 8, 1982 |
| WO 90/09829 | PCT | Sept. 7, 1990 |

Of these patents, U.S. Pat. No. 1,110,738, issued to Berecz on Sep. 15, 1914, discloses a flying and spinning toy in the manner of a spinning top with an aerial propeller whereby the top first spins in a flying movement through the air and continues to spin on the ground upon landing.

U.S. Pat. No. Des. 84,029, issued to J. C. Ditlevsen on Apr. 28, 1931, discloses the ornamental design for a flying top.

U.S. Pat. No. 4,183,168, issued to Roger E. Ross on Jan. 15, 1980, discloses a flying disk toy having a crank for providing rotational acceleration.

U.S. Pat. No. 4,309,038, issued to Donald M. Spoon on Jan. 5, 1982, discloses a throw toy having spoke-like graspable members which extend from a central hub.

U.S. Pat. No. 4,904,219, issued to Glenn M. Cox on Feb. 27, 1990, discloses an autorotating hand flyer that is of a specific one piece construction. Coxes hand flyer has a tapered wing and a substantially pointed front end and an arcuate cut out on the root at the trailing edge of the flyer. Both the leading and trailing edge of Cox's flyer are substantially convex. Further, Cox's flyer has a pointed tail.

U.S. Pat. No. 5,173,069, issued to Mark A. Litos on Dec. 22, 1992, also discloses an autorotative flyer having a concave leading edge and a convex trailing edge which is provided with specifically configured scallops. Litos's wing, wing spar and root are integrally formed. Moreover, Litos teaches a specific tapering of the wing from leading to trailing edge. Further, Litos teaches that the thickness and rearward extension of the spar diminishes from the root to the wing tip. This specific tapering of both the wing and the spar results in increased manufacturing costs.

U.S. Pat. No. 5,284,454, issued to George B. Randolph on Feb. 8, 1994, discloses a toy helicopter which is capable of a projected nose up ascent and a helicopter nose down descent.

U.S. Pat. No. 913,381 issued to P. S. May on Feb. 23, 1909 discloses a toy having a rigid spine, a weight disposed at one end of the spine, and a membrane folded over and enclosing the spine. The toy is further provided with a plurality of branches extending from the spine.

Each of the foreign patents disclose further embodiments of auto-rotating flyers. Those disclosed in the French Patent ('980) and the PCT application ('829) are each provided with a wing member having a hollow, plastic sphere, disc, or box. In each embodiment disclosed in these patents, the sphere, disc, or box is fabricated from two cooperating halves which are secured to the wing.

None of the above prior art references teaches an autorotating flyer having an associated device for producing sounds upon descent of the flyer to the ground after having been thrown into the air. Nor do the prior art devices disclose any other type of appurtenance carried by the flyer which is actuated upon descent of the flyer.

Accordingly, it is an object of this invention to provide an autorotating flyer for being thrown into the air, the flyer rotating upon descent to the ground.

Another object of the present invention is to provide such an autorotating flyer including an appurtenance which is activated by rotation of the flyer.

Still another object of the present invention is to provide an autorotating flyer as in the above object wherein the appurtenance is a sound-producing device activated by the air passing over the surface of the flyer wing.

Other objects and advantages over the prior art will become apparent to those skilled in the art upon reading the detailed description together with the drawings as described as follows.

DISCLOSURE OF THE INVENTION

In accordance with the various features of this invention, an autorotating flyer having a sound-making device is provided. The flyer of the preferred embodiment is provided with a spherical shock absorbing nose section and a wing section having a substantially straight leading edge, a curved tail, a spine conformed to said leading edge and tail and a curved trailing edge. The wing is constructed of a planar sheet of a lightweight, semi-rigid fabric of uniform thickness. The weight of the nose, the length and width of the wing are configured so as to impart aerodynamic characteristics to the flyer such that when thrown upward, the flyer will autorotate during descent. A noise-making device is carried by the flyer on the wing section at the tail proximate the leading edge. The noise-making device is constructed such that as the flyer rotates in the air, a portion of the passing air is passed though the device in order to create a noise, the type of noise being dependant upon the construction of the noise-making device. Typically, the noise is a whistle or a buzzing sound.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figures 1, 2:
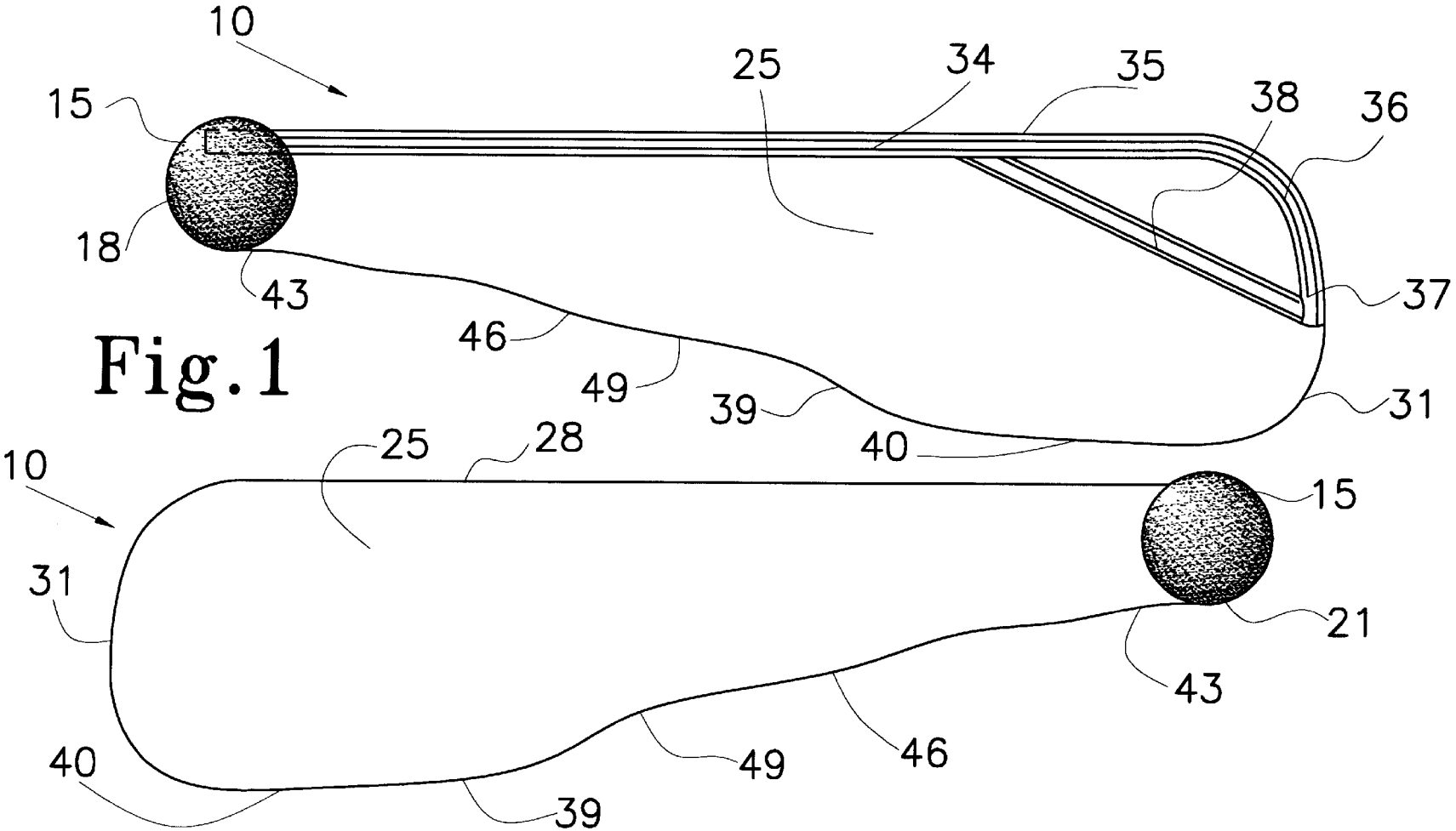
FIG. 1 illustrates a top plan view of an autorotating flyer incorporating several features of the present invention.
FIG. 2 illustrates a bottom plan view of the autorotating flyer illustrated in FIG. 1.
Figure 3:
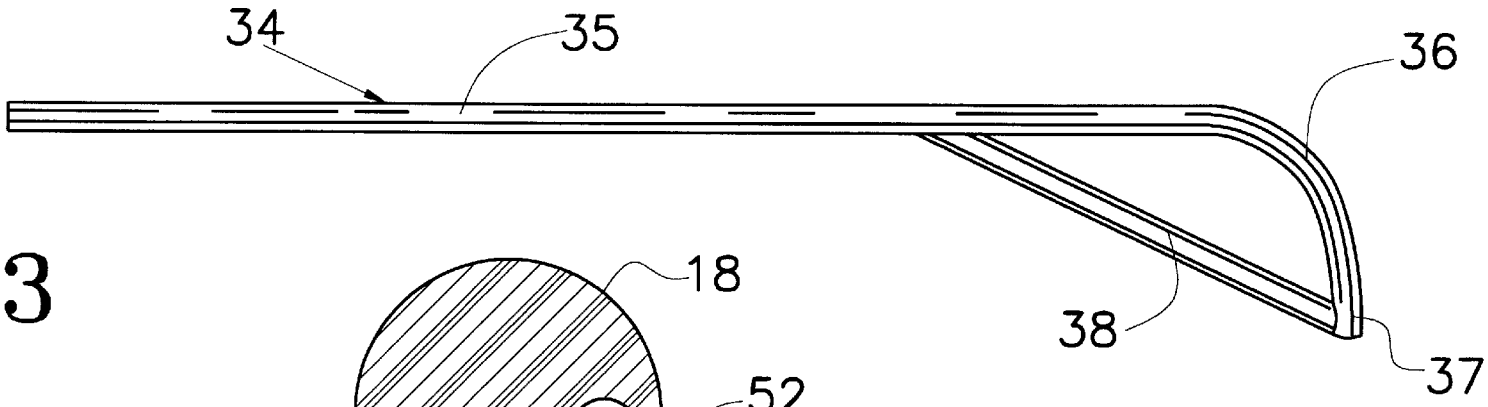
FIG. 3 illustrates a plan view of the wing brace of the autorotating flyer of the present invention.
Figure 4:
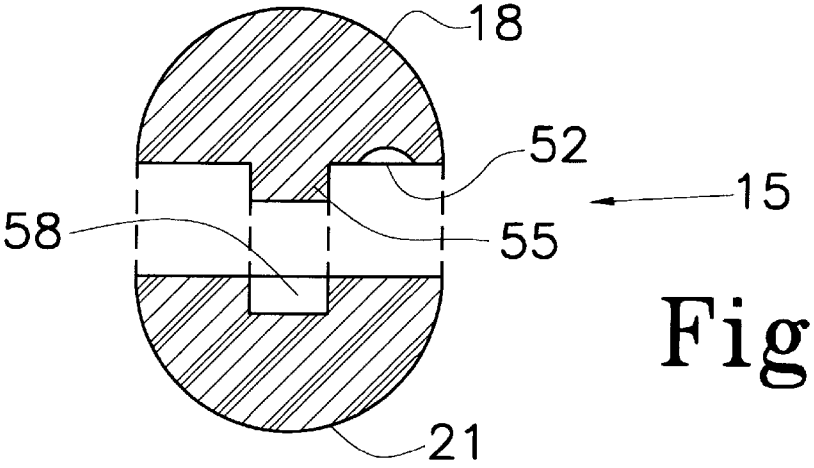
FIG. 4 illustrates a cross sectional view of the nose member of the autorotating flyer of the present invention.
Figure 5:
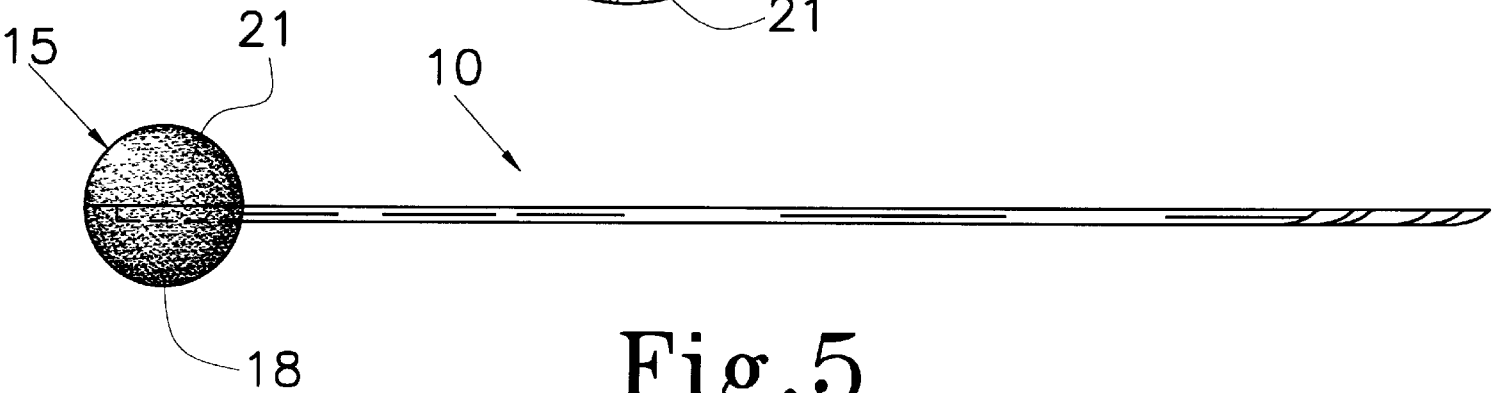
FIG. 5 illustrates a side view of the autorotating flyer of the present invention.

An autorotating flyer, constructed in accordance with the present invention, is illustrated generally as 10 in the Figures. A preferred embodiment of the autorotating flyer 10 which is incorporated in the present invention is illustrated in FIGS. 1–5, and as previously described in my application Ser. No. 08/353,057, filed Dec. 9, 1994.

In the embodiment illustrated in FIGS. 1–5, the autorotating flyer 10 has an overall length in the range of about 200 mm to about 365 mm and has an overall weight in the range of about 11.5 grams ("g") to about 26 g. The autorotating flyer 10 is provided with a substantially spherical nose section 15. The nose section 15 is comprised of a substantially spherical member that is split into an upper hemisphere 18 and a lower hemisphere 21. The nose section 15 is constructed of a substantially resilient material that is shock absorbent such as, though not limited to, rubber. In the preferred embodiment, the nose section 15 weighs in the range of about 8.5 g to about 13.9 g.

The wing section 25 has a substantially straight leading edge 28, a curved tail 31, a spine 34 conformed to the leading edge 28 and the tail 31 and a curved trailing edge 39. Spine 34 has a substantially straight segment 35, disposed along the leading edge 28, a curved segment 36 disposed along the tail 31 and a distal end 37. A brace 38 is disposed on the spine 34 from a position on the straight segment 35 proximal to the curved segment 36 extending therefrom to a distal end 37, thus providing a graspable member. The trailing edge 39 has a compound curve consisting of at least one substantially convex region 40 proximate the tail 31 and at least one substantially concave region 43. In the preferred embodiment, a substantially convex region 46 is disposed between the concave region 43 and a second concave region 49. In the preferred embodiment, the convex region 40 defines the longest chord of the wing 25 while the concave region 43 defines the shortest chord of the wing 25. The wing 25 is constructed of a substantially planar sheet of a lightweight, semi-rigid fabric of uniform thickness. It will be understood that the wing 25 could also be constructed of a planar sheet of plastic of uniform thickness and that the present invention is not limited to these materials. The wing 25 weighs in the range of about 1.0 g to about 2.2 g. The spine 34 and the brace 38 weigh in the range of about 1.8 g to about 7.9 g. The weight of the nose 15, the wing 25, including the spine 34 and the brace 38 and the length and width of the wing 25 are configured so as to impart aerodynamic characteristics, which are known in the art, to the autorotating flyer 10 such that when thrown upward, the autorotating flyer 10 will autorotate during descent. Although specific ranges of weights and dimensions are disclosed, it will be understood that the present invention is not limited to these weights and dimensions.

The proximal end of the wing 25 is disposed between the upper hemisphere 18 and the lower hemisphere 21. In the illustrated embodiment, the proximal end of the spine 34 is received in a groove 52 in one of the hemispheres 18,21, preferably the upper hemisphere 18 such that the proximal end of the spine 34 is also disposed between the upper hemisphere 18 and the lower hemisphere 21. The upper hemisphere 18 and the lower hemisphere 21 are securely joined together with an adhesive, preferably an epoxy. In order to prevent axial twisting between the upper hemisphere 18 and the lower hemisphere 21, a locking tab 55 is disposed on the upper hemisphere 18. The locking tab 55 registers with and is received by the notch 58 in the lower hemisphere 21. Of course, other conventional methods of securing the wing 25 to the upper and lower hemispheres 18,21 may be used as well. That method disclosed herein is for illustration purposes only and is not intended to limit the present invention.

As illustrated in FIGS. 6–9, a sound-making device 80 is carried by the autorotating flyer 10 of the present invention. As the autorotating flyer 10 descends to the ground after having been thrown in the air, and as the autorotating flyer 10 thus rotates, a portion of the air passing around the autorotating flyer 10 is directed through the sound-making device 80 such that a particular sound is generated. For example, the embodiment illustrated in FIGS. 6 and 7 generates a whistle, while the embodiment illustrated in FIGS. 8 and 9 generates a buzzing sound. Other configurations of sound-making devices 80 may be used as well. Further, it is envisioned that light-generating or otherwise decorative devices (not shown) may be used to create various effects produced by the rotation of the autorotating flyer 10 upon descent to the ground.

Figure 6:
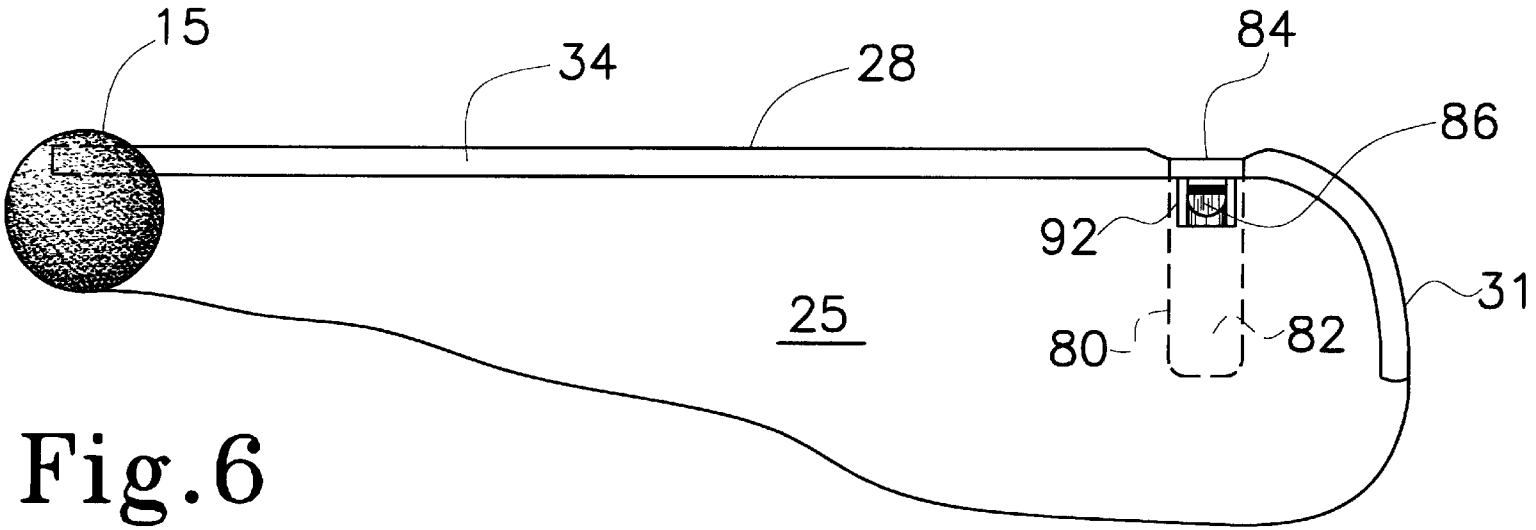
FIG. 6 is a plan view of one embodiment of an autorotating flyer of the present invention incorporating a sound-making device.
Figure 7:
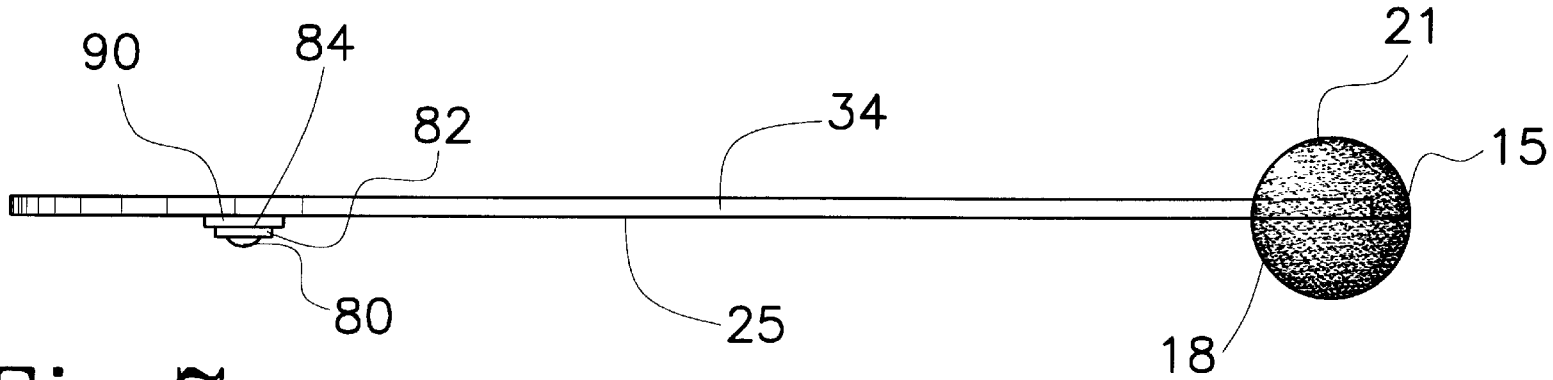
FIG. 7 is an elevation view of the autorotating flyer illustrated in FIG. 6.

In the embodiment illustrated in FIGS. 6 and 7, and as best illustrated in FIG. 6, the sound-making device 80 is a whistle having an inlet 84 for the entrance of air at one end and an outlet 86 on a bottom side 90 for the exit of air. The sound-making device 80 defines an interior configuration accessible through the inlet 84 and outlet 86, the particular configuration being chosen to generate a particular pitch and volume upon rotation of the autorotating flyer 10. The sound-making device 80 is carried by the wing 25 on the leading edge 28 thereof and proximate the tail 31. The inlet 84 of the sound-making device 80 is positioned proximate the leading edge 28 with the housing 82 of the sound-making device 80 being oriented in a direction substantially tangential to the direction of rotation of the autorotating flyer 10. The bottom side 90 of the sound-making device 80 is engaged with the wing member 25 in a conventional manner such as by gluing. The wing member 25 of the autorotating flyer 10 defines an opening 92 configured to cooperate with the outlet 86 of the sound-making device 80 to enable the passage of air from the sound-making device 80.

Figure 8:
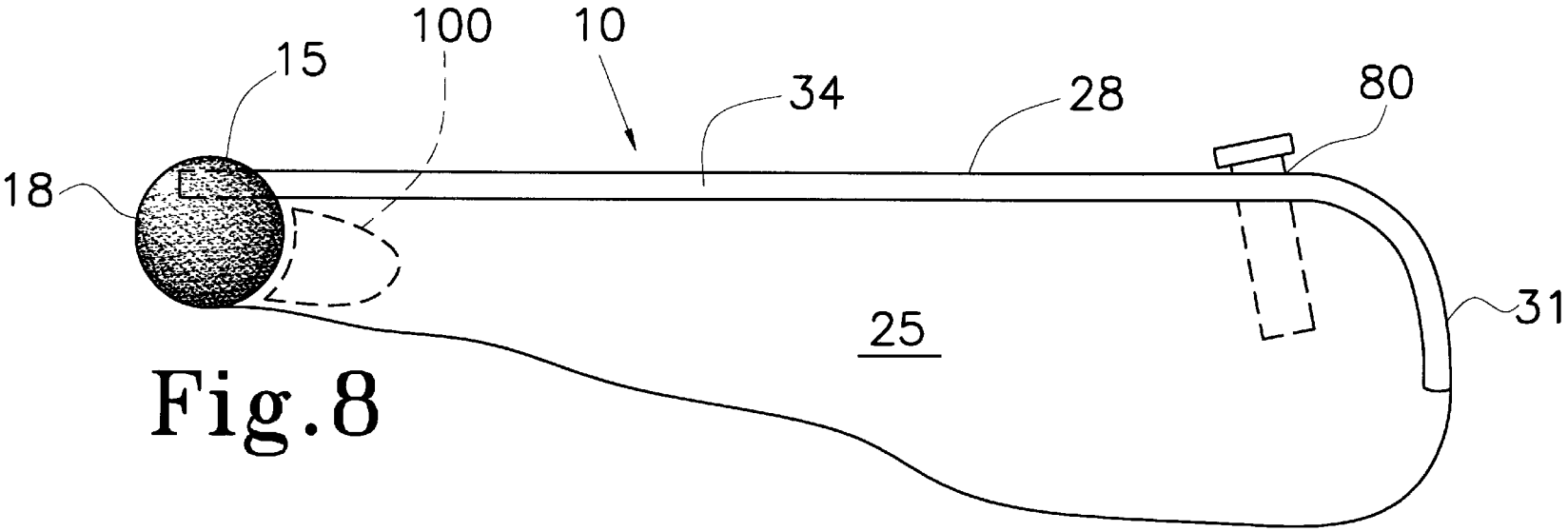
FIG. 8 is a plan view of an embodiment of an autorotating flyer of the present invention incorporating an alternate sound-making device.
Figure 9:
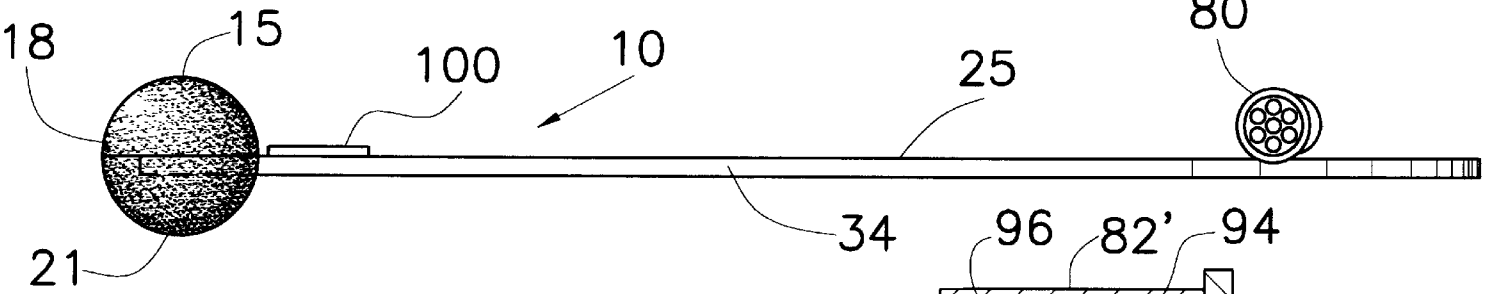
FIG. 9 is an elevation view of the autorotating flyer illustrated in FIG. 8.
Figure 10:
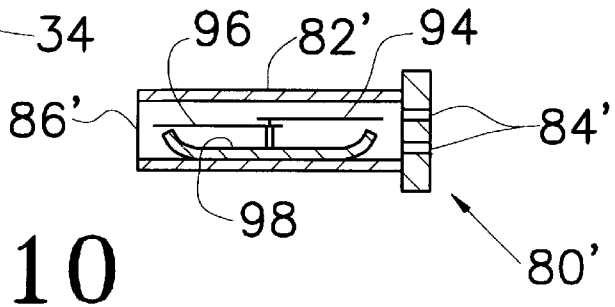
FIG. 10 illustrates a cross-section of the sound-making device incorporated in the embodiment illustrated in FIG. 8.

In the embodiment illustrated in FIGS. 8 and 9, the sound-making device 80' is a buzzer having an inlet 84' for the entrance of air at one end and an outlet 86' at a further end for the exit of air. The sound-making device 80', as best illustrated in FIG. 10, includes a housing 82' which defines a substantially cylindrical interior, and at least one reed for creating a buzzing sound as air is passed through. As illustrated, the preferred embodiment of this type of sound-making device 80' includes first and second reeds 94,96, both secured at first ends in the center of the housing 82', and oriented in opposing directions. Thus, the first reed 94 is vibrated as a result of entering air, and the second reed 96 is vibrating as a result of exiting air. The first and second reeds 94,96 are disposed above a sounding chamber 98 to enhance the sound generated by the first and second reeds 94,96 upon their respective vibrations. The sound-making device 80' is carried by the wing 25 on the leading edge 28 thereof and proximate the tail 31. The inlet 84' of the sound-making device 80' is positioned proximate the leading edge 28 with the housing 82' of the sound-making device 80' being oriented in a direction substantially tangential to the direction of rotation of the autorotating flyer 10. The sound-making device 80' is carried by the wing member 25 in a conventional manner such as by gluing.

In each of these embodiments, the proportionate weights of the separate components of the autorotating flyer 10 are such that rotation of the autorotating flyer 10 is accomplished while also generating an audible sound. As illustrated in FIG. 8, a wing stabilizer 100 may be required proximate the lower hemisphere 21 of the nose 15. For the above described weight ranges, the wing stabilizer 100 may be approximately 5.5 grams. However, dependant upon the particular weights, sizes, and configurations of the various components herein described, the weight of the wing stabilizer 100 may be greater, smaller, or not necessary at all.

Although the present invention has been described as being incorporated with a particular autorotating flyer, it will be recognized that the sound-making device of the present invention may be incorporated on any autorotating flyer in order to generate an audible sound upon descent of the autorotating flyer to the ground.

From the foregoing description, it will be recognized by those skilled in the art that an autorotating flyer offering advantages over the prior art has been provided. Specifically, the autorotating flyer is provided with a sound-making device for generating an audible sound upon descent of the autorotating flyer to the ground. The sound-making device may be of any type producing an audible sound, such as one generating a whistle, or one generating a buzzing sound.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An autorotating flyer comprising:

at least one wing member having a substantially planar configuration and defining a proximal and a distal end and a top and a bottom surface, said at least one wing member defining a substantially straight leading edge, a curved tail, and a curved trailing edge;

a substantially spherical nose member defining upper and lower hemispheres carried by each said at least one wing member proximate said proximal end, said at least one wing member proximal end being disposed between said upper and lower hemispheres, said at least one wing member and said nose member cooperating to effect rotation of said autorotating flyer upon descent to the ground after being thrown into the air;

a spine carried by said wing member proximate said leading edge, said spine being conformed to said leading edge and said curved tail, said spine having a substantially straight segment from a proximal end received within a groove defined by said upper hemisphere of said substantially spherical nose member and disposed along said leading edge, a curved segment integrally formed with said substantially straight segment, disposed along said tail, and terminating at a distal end, said spine defining a continuous width from said proximal end to said distal end; and a sound making device carried by said wing member, said sound making device including a housing defining an interior volume, an air inlet, and an air outlet, said sound making device being configured to generate a sound upon passage of air into said air inlet, through said interior volume, and through said air outlet such that as said autorotating flyer rotates in descent to the ground, air is passed through said sound making device and said sound is generated.

2. The autorotating flyer of claim 1 wherein said sound making device is provided for generating a whistle sound upon rotation of said autorotating flyer.

3. The autorotating flyer of claim 1 wherein said sound making device is provided for generating a buzzing sound, said sound making device further including at least one reed within said housing, said reed vibrating upon passage of air through said interior volume in order to generate said buzzing sound.

4. The autorotating flying toy of claim 1 wherein said nose member is constructed of a substantially shock absorbent, resilient material.

5. The autorotating flyer of claim 1 including a single of said at least one wing member, said sound making device being carried by said wing member at a distal end thereof.

6. The autorotating flying toy of claim 5 wherein said wing is constructed of a substantially planar sheet of a lightweight, semi-rigid material of uniform thickness.

* * * * *